US011745994B2

(12) United States Patent
Marcink

(10) Patent No.: US 11,745,994 B2
(45) Date of Patent: Sep. 5, 2023

(54) FUNNEL WITH VENTS FOR VISCOUS FLUIDS

(71) Applicant: BTM Designworks, LLC, Springfield, MO (US)

(72) Inventor: Paul Michael Marcink, Springfield, MO (US)

( * ) Notice: Subject to any disclaimer, the term of this patent is extended or adjusted under 35 U.S.C. 154(b) by 0 days.

(21) Appl. No.: 17/578,449

(22) Filed: Jan. 19, 2022

(65) Prior Publication Data

US 2022/0227616 A1 Jul. 21, 2022

Related U.S. Application Data

(60) Provisional application No. 63/137,983, filed on Jan. 15, 2021.

(51) Int. Cl.
*B67C 11/02* (2006.01)

(52) U.S. Cl.
CPC ..... *B67C 11/02* (2013.01)

(58) Field of Classification Search
CPC ..... B67C 11/02
USPC ..... 141/331–345
See application file for complete search history.

(56) References Cited

U.S. PATENT DOCUMENTS

| | | | | | |
|---|---|---|---|---|---|
| 1,368,640 | A * | 2/1921 | Melchior | B67C 11/02 | D7/700 |
| 3,334,574 | A * | 8/1967 | Douglas | A47J 31/02 | D7/400 |
| 4,205,710 | A * | 6/1980 | Dunicz | E03C 1/26 | 141/297 |
| 5,762,120 | A * | 6/1998 | Smith | B67C 11/02 | 141/331 |
| 6,425,424 | B1 * | 7/2002 | Ellis Calvo | B67C 11/02 | 141/331 |
| 8,826,949 | B2 * | 9/2014 | Kent | B67C 11/02 | 141/342 |
| D717,110 | S * | 11/2014 | De Leo | D7/400 | |
| 10,709,283 | B2 * | 7/2020 | Kuempel | A47J 31/02 | |
| D915,135 | S * | 4/2021 | Lin | D7/400 | |

* cited by examiner

*Primary Examiner* — Timothy L Maust
(74) *Attorney, Agent, or Firm* — Alvin R. Wirthlin

(57) ABSTRACT

A vented funnel for transferring liquid from one container to another includes a base portion adapted for connection to the container, a converging portion connected to the base portion, and a vent portion located between the base portion and the converging portion. The vent portion has a plurality of vent openings extending between the base portion and the converging portion and a plurality of ribs located between the vent openings so that each vent opening is separated from an adjacent vent opening by one of the plurality of ribs. In this manner, air within the container flows through the vent openings when liquid discharged from the converging portion displaces air in the container. The ribs extend between the base portion and the converging portion so that the ribs solely support the converging portion on the base portion while defining the vent openings.

20 Claims, 12 Drawing Sheets

FUNNEL WITH VENTS FOR VISCOUS FLUIDS

CROSS-REFERENCE TO RELATED APPLICATIONS

This application claims the benefit of U.S. Provisional Application No. 63/137,983 filed on Jan. 15, 2021, the disclosure of which is hereby incorporated by reference in its entirety.

BACKGROUND OF THE INVENTION

Prior art funnels are unstable, difficult to manipulate by one person when used to transfer liquids from one container to another, notoriously inefficient in that they fill up faster than they can drain, inadvertently causing messy spills and wasted fluid, especially when the user is distracted by trying to stabilize the funnel with one hand on a container to be filled while pouring from the container to be emptied with another hand. Prior art funnel inefficiency is exasperated when viscous fluids, such as oils, are being transferred from one container having a large opening, to another container having a relatively small opening. For example, many consumers prefer to deep fry food such as poultry, turkey, and other meats, as well as potatoes and other vegetables, in a large outdoor pot filled with oil. The large pot is typically placed on a propane burner and the oil is heated to a predetermined temperature prior to immersing the food in the oil. When the deep frying is done and the oil has cooled, it is desirable to pour the oil back into the container from which it was removed to be used again, as the oil may be used multiple times prior to being disposed or recycled. Although low-cost oils are available and have been used, more expensive oils, such as peanut oil, animal fats, combinations thereof, and so on, which impart a particular taste to the food, are more desirable. Accordingly, using higher quality oils more than once necessitates returning the used oil to its original container. With typical outdoor deep fryer pots, it is common to transfer the entire contents of a five-gallon container of cooking oil into the pot, then return the used oil back into the five-gallon container. Since prior art funnels are unstable, distracting and, due to their universal design for transferring low-viscosity liquids into containers having small neck openings, fail to efficiently transfer more viscous liquids, such as cooking oil, between the fryer pot and the original container, resulting in messy spills, wasted oil, damage to surfaces, clothing, and so on. Moreover, air within the container, which must be displaced as the container is filled, is forced through the narrow neck of the funnel, creating air bubbles in the viscous fluid, adding to inefficient transfer of viscous fluid into the container, and thus exacerbating the difficulties of using such funnels. Although pouring the viscous liquid at a slower rate can help reduce the Although vented funnels have been proposed for use with viscous fluids to create a separate pathway for air to leave the container during filling, the vents not only interfere with the narrow funnel neck and thus fail to create an efficient transfer of fluid into the container, but are difficult to manufacture, requiring multiple parts that must be formed separately and assembled, adding to manufacturing cost and ultimately greater expense to the consumer.

Accordingly, there continues to be a need for the provision of a funnel that efficiently transfers viscous fluids from one container to another, while overcoming one or more of the drawbacks of the prior art.

SUMMARY OF THE INVENTION

In accordance with one aspect of the invention, a vented funnel for transferring liquid from one container to another includes a base portion adapted for connection to the container, a converging portion connected to the base portion, and a vent portion located between the base portion and the converging portion. The vent portion has a a plurality of vent openings extending between the base portion and the converging portion and a plurality of ribs located between the vent openings so that each vent opening is separated from an adjacent vent opening by one of the plurality of ribs. In this manner, air within the container flows through the vent openings when liquid discharged from the converging portion displaces air in the container.

In accordance with a further aspect of the invention, the plurality of ribs extend between the base portion and the converging portion so that the plurality of ribs solely supports the converging portion on the base portion.

In accordance with a further aspect of the invention, the converging portion has a first continuous wall with a first converging section and a first slope, and at least a further converging section with a further slope different from the first slope, which in one exemplary embodiment is less than the first slope.

In accordance with yet a further aspect of the invention, a nozzle portion extends from the converging portion and includes a nozzle wall defining a discharge port. The first converging section has a first height and the nozzle wall has a second height that is much smaller than the first height to thereby minimize material required for the vented funnel. Preferably, the second height is sufficient to prevent liquids from being sucked into the vent portion and expelled outside of the container while being discharged through the discharge port.

BRIEF DESCRIPTION OF THE DRAWINGS

The following detailed description of the preferred embodiments of the present invention will be best understood when considered in conjunction with the accompanying drawings, wherein like designations denote like elements throughout the drawings, and wherein.

Figure 1:
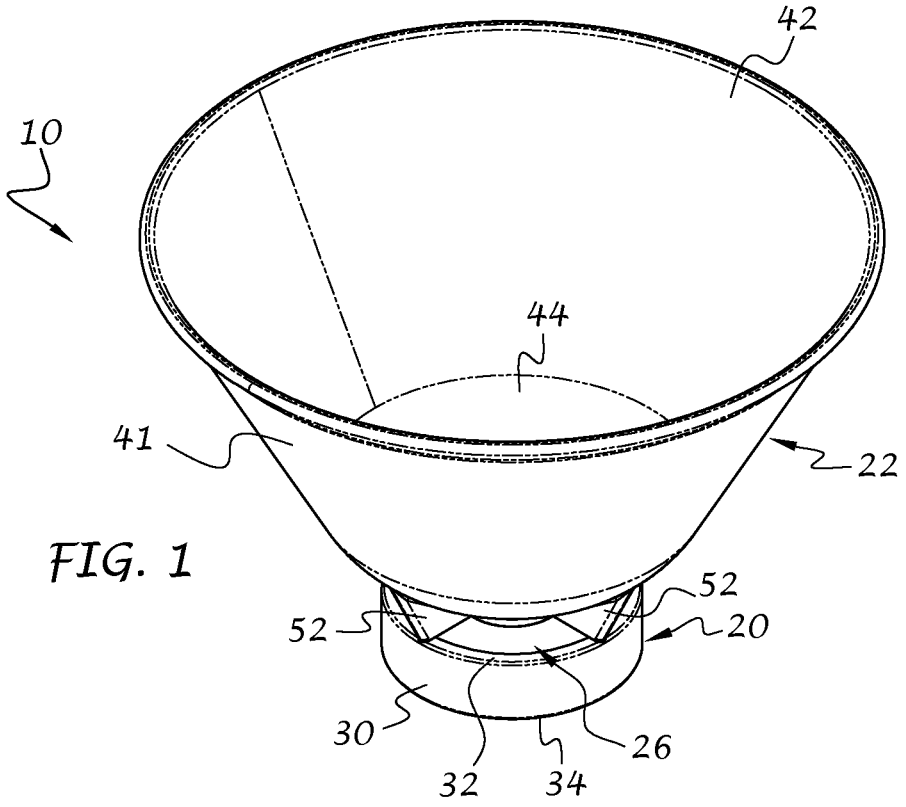
FIG. 1 is a top isometric view of a vented funnel in accordance with an exemplary embodiment of the invention.

It is noted that the drawings are intended to depict only exemplary embodiments of the invention and therefore should not be considered as limiting the scope thereof. It is further noted that the drawings may not be to scale. The invention will now be described in greater detail with reference to the accompanying drawings.

DETAILED DESCRIPTION OF THE INVENTION

Referring now to the drawings, and to FIGS. 1-6 in particular, a vented funnel 10 in accordance with an exemplary embodiment of the present invention is illustrated. The vented funnel 10 is useful for facilitating the efficient transfer of liquids from one container to another, and especially transferring viscous liquids, such as oil, from a larger container (not shown) with a wide opening to a smaller container 12 (FIGS. 5 & 6) with a narrow opening 14 surrounded by a neck 16 with external threads 18. The vented funnel 10 of the present invention can be connected to the neck 16 of a container 12 to facilitate the efficient transfer of oil or other viscous liquids used in cooking from a large pot, such as a stock pot used in deep frying for example, through the opening 14 into the container 12, such as the original container the oil or other viscous liquids were stored and transported in, for storing the oil after it has been dispensed therefrom, so that the oil can be reused, recycled, and/or properly disposed of while minimizing drawbacks of the prior art as discussed above. It will be understood that the vented funnel 10, including its various embodiments as described herein, can be adapted for use with any container, tank, reservoir, and so on, to facilitate the efficient transfer of any fluid into the container without departing from the spirit and scope of the invention.

Referring now to FIGS. 1-8, the vented funnel 10 preferably includes a base portion 20, a converging portion 22 positioned above the base portion, a nozzle portion 24 extending downwardly from the converging portion, and a vent portion 26 located between the base portion 20 and the converging portion 22. A central axis 25 extends through the base portion 20, nozzle portion 24, and converging portion 22.

The base portion 20 preferably includes an annular side wall 30 with an upper edge 32, a lower edge 34, an outer surface 36 extending between the upper and lower edges, and in inner surface 38 spaced concentrically from the outer surface 36 and extending between the upper and lower edges. Internal threads 40 are formed on the inner surface 38 of the annular side wall 30 for engaging the external threads 18 (FIGS. 5 & 6) of the storage container neck 16 to provide a stable connection between the vented funnel 10 and the container. However, it will be understood that the vented funnel 10 can be used with other containers, threaded or unthreaded. It will be further understood that the threads 40 can be removed without departing from the spirit and scope of the invention. Likewise, other means for connecting the funnel to a container can be used. For example, when the container does not have a threaded neck, the base portion 20 can be arranged to engage the opening of the container and/or to be supported on a wall of the container surrounding the opening.

Figure 5:
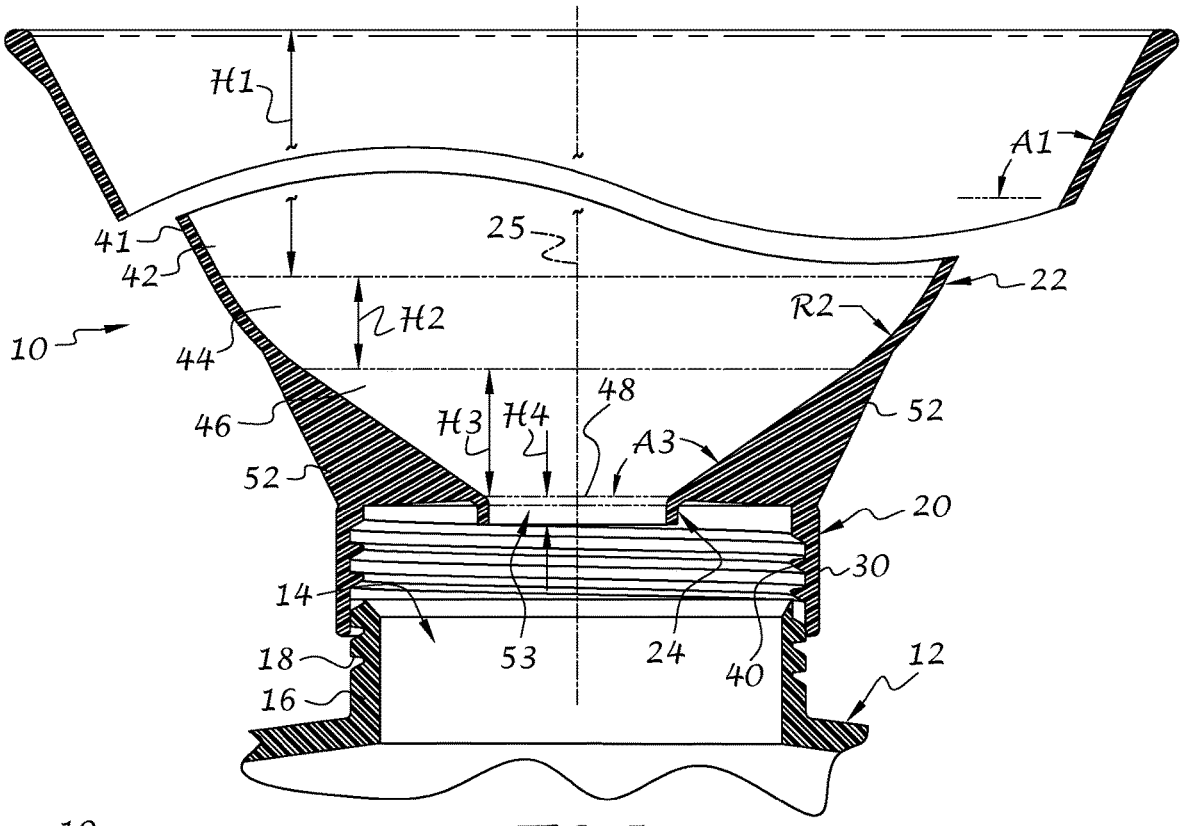
FIG. 5 is an enlarged cross-sectional view thereof taken along line 5-5 of FIG. 4 for connection to a container.

The converging portion 22 comprises a continuous wall 41 with a first converging section 42, a second converging section 44 extending downwardly and inwardly from the first converging section 42, and a third converging section 46 extending downwardly and inwardly from the second converging section 44 to the nozzle portion 24. As best shown in FIGS. 1, 2, 5, 6, and 8, the first converging section 42 and the third converging section 46 are preferably conical in shape, while the second converging section 44 gently curves between the first and third converging sections. In addition, as best shown in FIG. 5, the first converging section 42 has a first angle or slope A1 with respect to horizontal and a first height H1, the second converging section 44 has a radius of curvature R2 and a second height H2, while the third converging section 46 has a second angle or slope A3 and a third height H3. In accordance with a preferred embodiment of the invention, and by way of example, the first angle or slope A1 is greater than the second angle or slope A3, while the first height H1 is greater than the third height H3, and much greater than the second height H2, while the radius of curvature R2 is greater than the height H2. In this manner, the present invention ensures that fluid entering the converging portion 22 moves through the first converging section 42 at a first average flow or discharge rate, transitions through the second converging section 44 at a second average flow or discharge rate, and flows through the third converging section 46 at a third average flow or discharge rate. With the curved shape of the second converging section 44, the first average flow rate transitions smoothly to the third average flow rate, ensuring laminar flow throughout the converging portion 22. By way of example, the first angle A1 and first height H1 are greater than the third angle A3 and the third height H3, respectively. Accordingly, the first flow rate is greater than the third flow rate, while the second flow rate changes through the radius of curvature R1 between the first and third flow rates. In this manner, fluid pressure at the entrance 48 of the nozzle portion 24 advantageously increases to ensure liquid discharging from the nozzle portion is received in the container in a controlled manner, while ensuring liquid entering the container is prevented from being directed through the vent portion 26.

The nozzle portion 24 preferably includes an annular nozzle wall 50 extending downward from the third converging section 46 defining a discharge orifice or port 53. A height H4 of the nozzle portion 24 is much smaller than each of the heights H1, H2, and H3 of the first, second and third converging sections 42, 44, and 46, respectively. The height H4 of the nozzle portion is preferably selected to thereby minimize the amount of material required for the vented funnel 10, thereby lowering material and manufacturing costs, as well as reducing frictional forces that might further impede the flow of liquids into the container from the funnel. Moreover, the height H4 of the nozzle portion, although relatively small, is sufficient to prevent liquids, and more especially viscous liquids, from being sucked into the vent portion 26 and expelled outside of the container during use.

In accordance with an exemplary embodiment of the invention, the height H4 is generally in the range of about 0.15×H3 to about 0.75×H3, and more particularly in the range of about 0.20×H3 to about 0.30×H3.

Likewise, in accordance with an exemplary embodiment of the invention, the height H3 of the third converging section 46 is generally in the range of about 0.15×H1 to about 0.75×H1, and more particularly in the range of about 0.20×H1 to about 0.30×H1.

Moreover, in accordance with an exemplary embodiment of the invention, the height H2 of the second converging section 46 is generally in the range of about 0.10×H1 to about 0.30×H1, and more particularly in the range of about 0.12×H1 to about 0.20×H1.

With the above-described exemplary ranges, when the H1 of the first converging section is about three inches, for example, the heights H2, H3 and H4 have proportional values so that liquid traveling through the vented funnel 10 is efficiently transferred to a container.

Referring again to FIGS. 1-8, the vent portion 26 is located between the base portion 20 and the converging portion 22 and includes a plurality of supports or ribs 52 that extend between the upper edge 32 of the base portion 20 and the continuous wall 41 associated with the third converging section 46 and a section of the second converging section 42, such that the converging portion 22 is spaced from the base portion 20 and supported solely by the ribs 52. Vent openings 54 are located between adjacent ribs 52 to allow air to escape from the container 12, as shown by arrows 55 in FIG. 6, when displaced by liquid discharged into the container from the nozzle portion 24.

Figure 6:
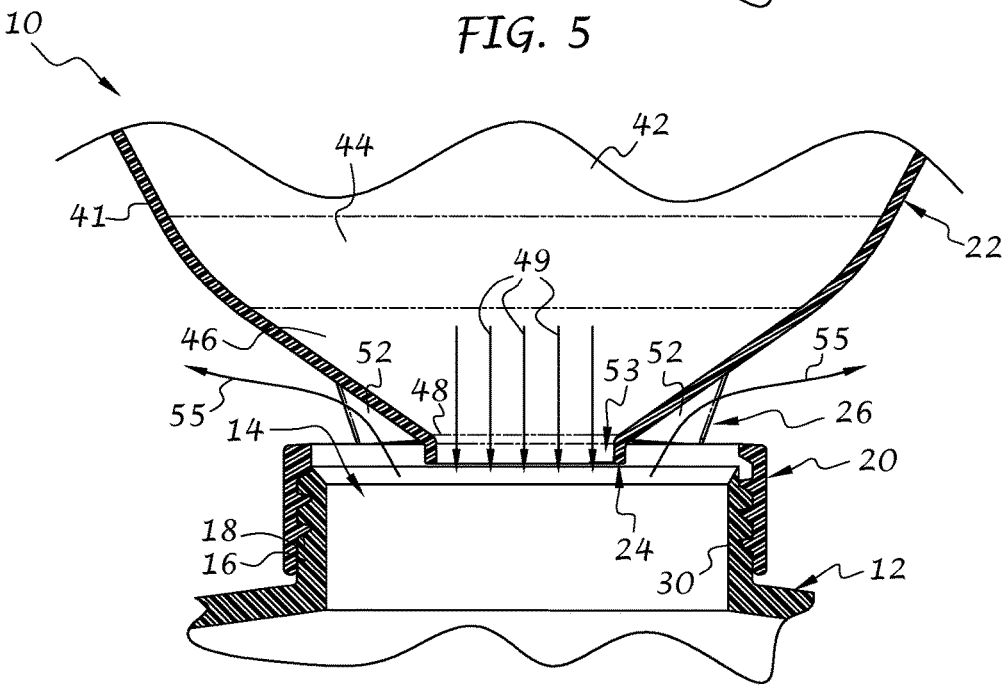
FIG. 6 is an enlarged diagonal cross-sectional view thereof taken along line 6-6 of FIG. 4 connected to a container.
Figure 7:
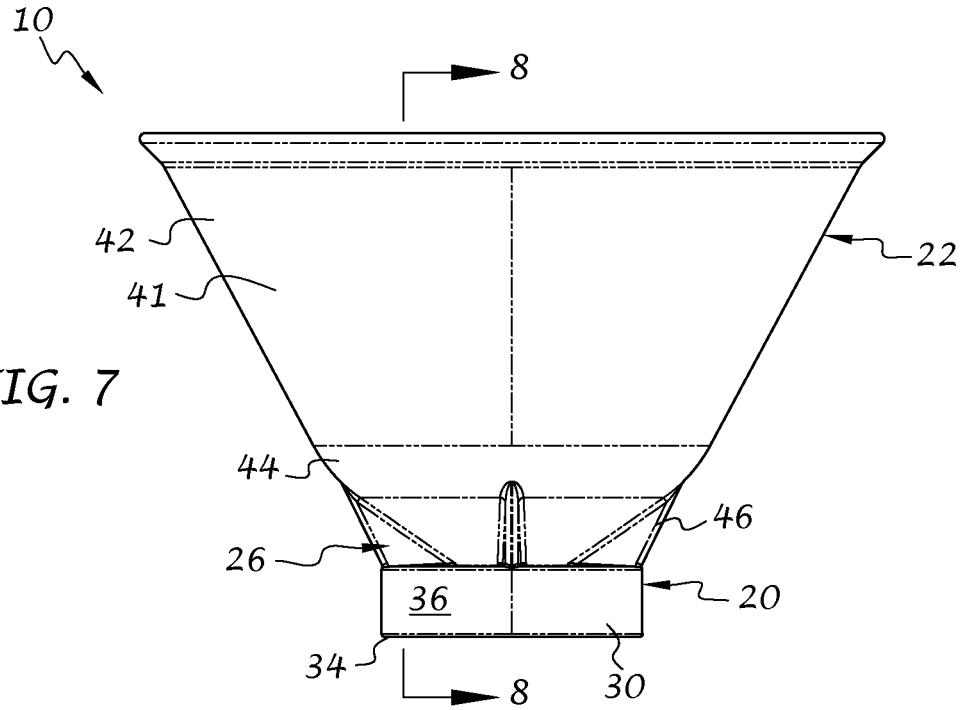
FIG. 7 is a side elevational view thereof.
Figure 8:
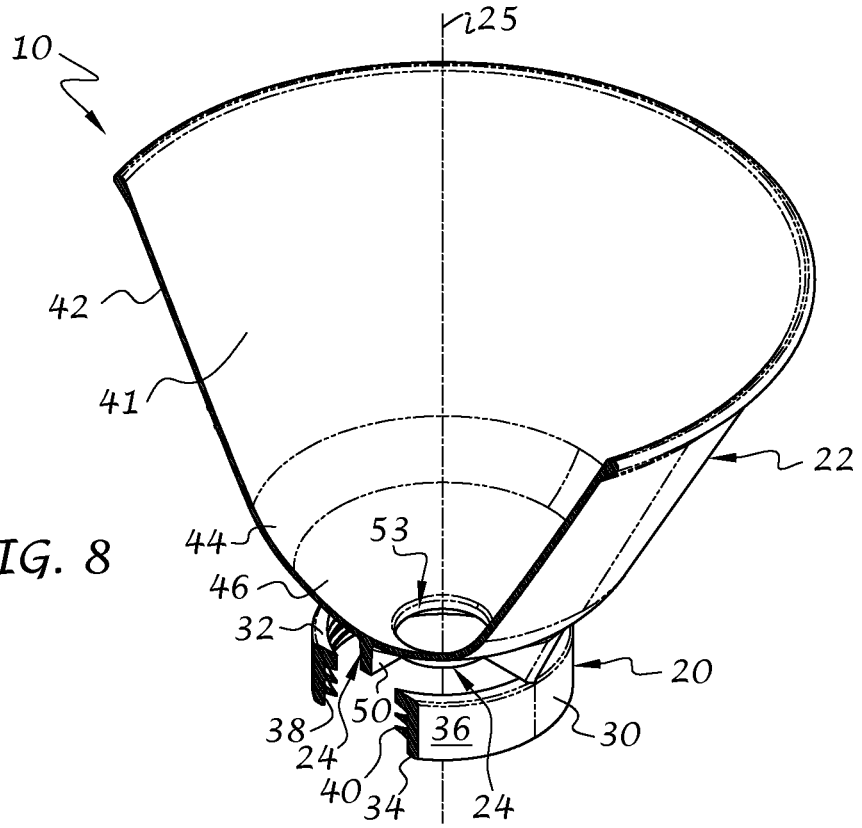
FIG. 8 is an isometric sectional view taken along line 8-8 of FIG. 7.
Figure 9:
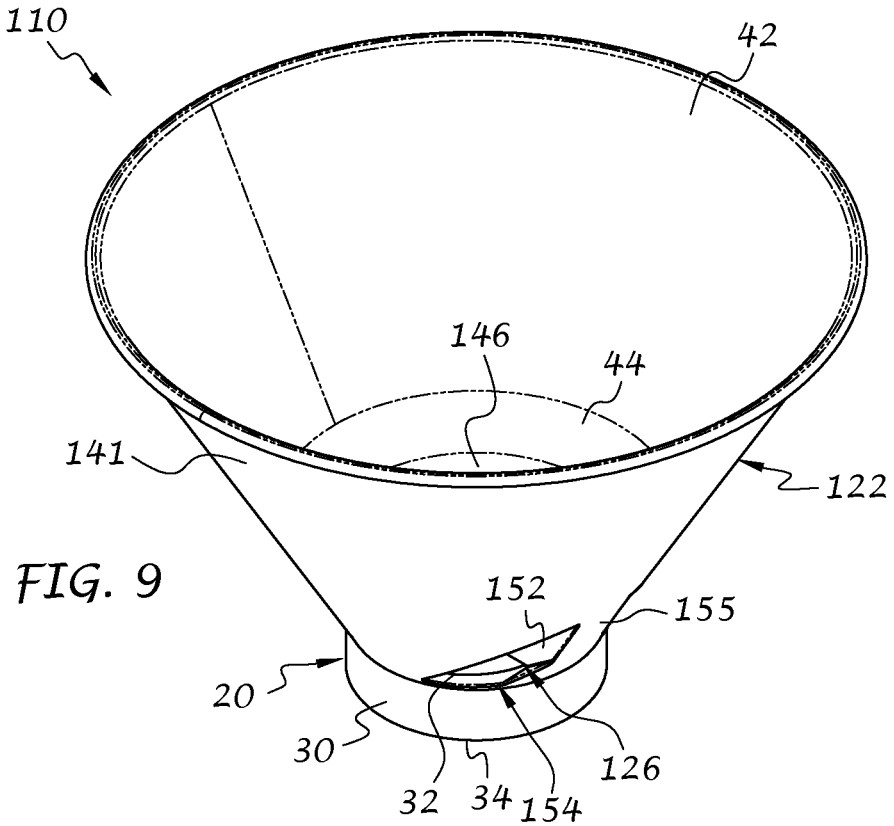
FIG. 9 is a top isometric view of a vented funnel in accordance with a further exemplary embodiment of the invention.
Figure 10:
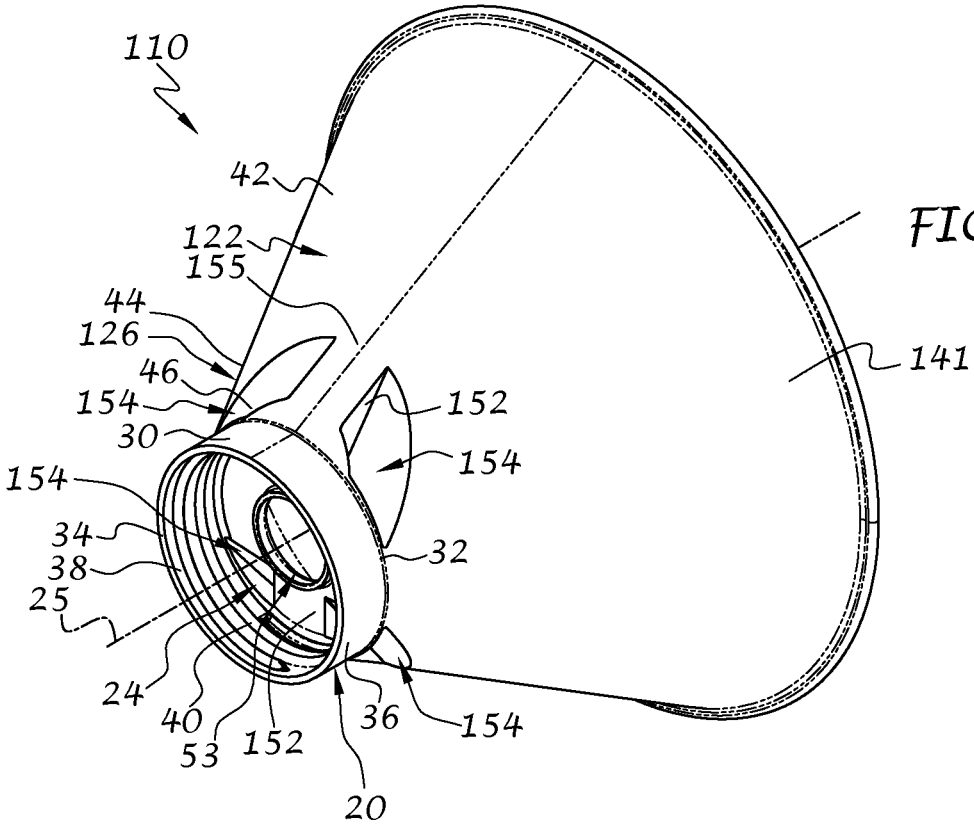
FIG. 10 is a bottom isometric view thereof.
Figure 11:
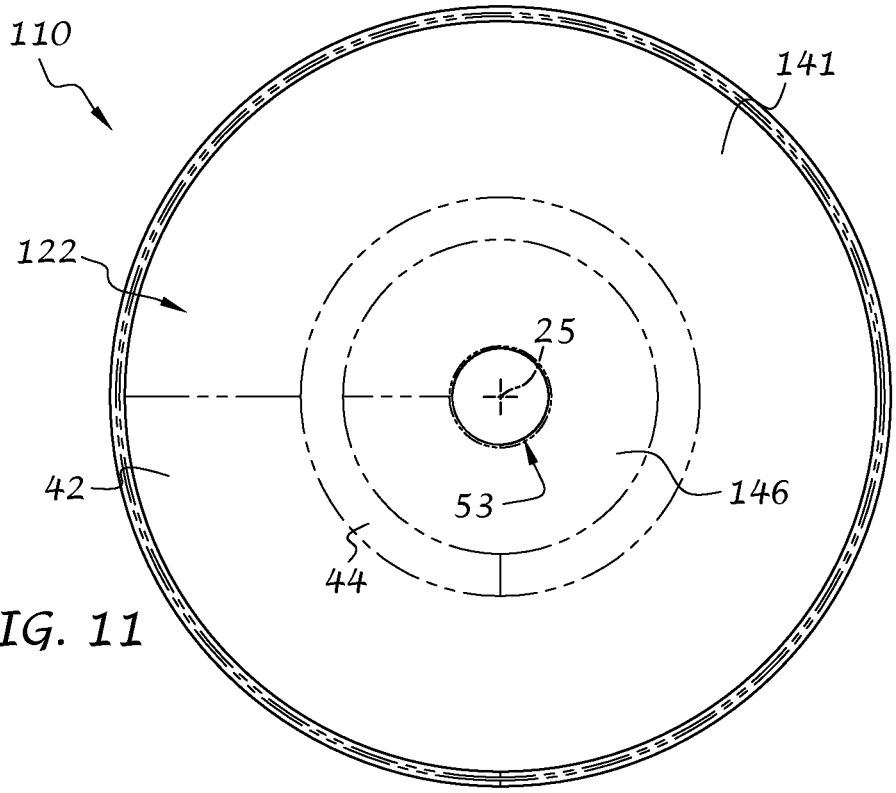
FIG. 11 is a top plan view thereof.

As shown in FIG. 6, four ribs 52 extend radially outwardly from the central axis 25 of the nozzle portion 24 and are spaced equidistant about a periphery of the nozzle portion 24 to form four vent openings 54 through which air in the container can escape. It will be understood that more or less ribs and vent openings can be provided without departing from the spirit and scope of the invention.

Figure 2:
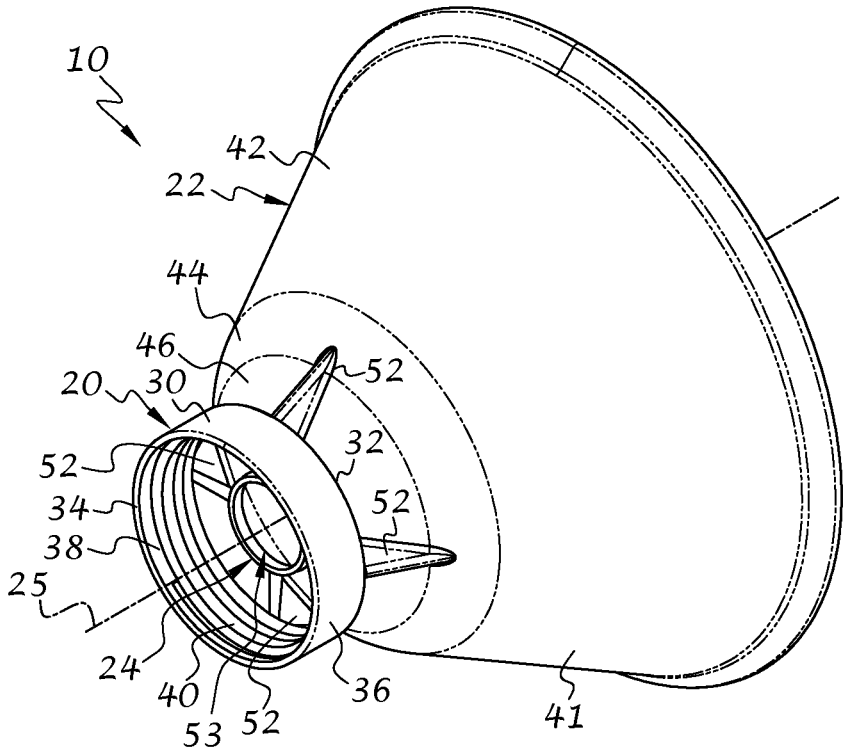
FIG. 2 is a bottom isometric view thereof.
Figure 3:
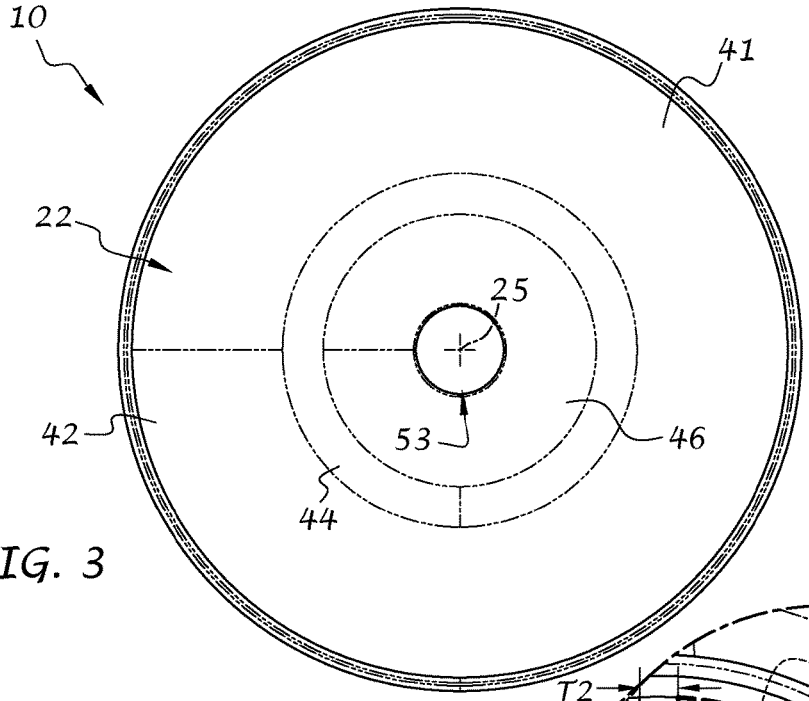
FIG. 3 is a top plan view thereof.
Figure 4:
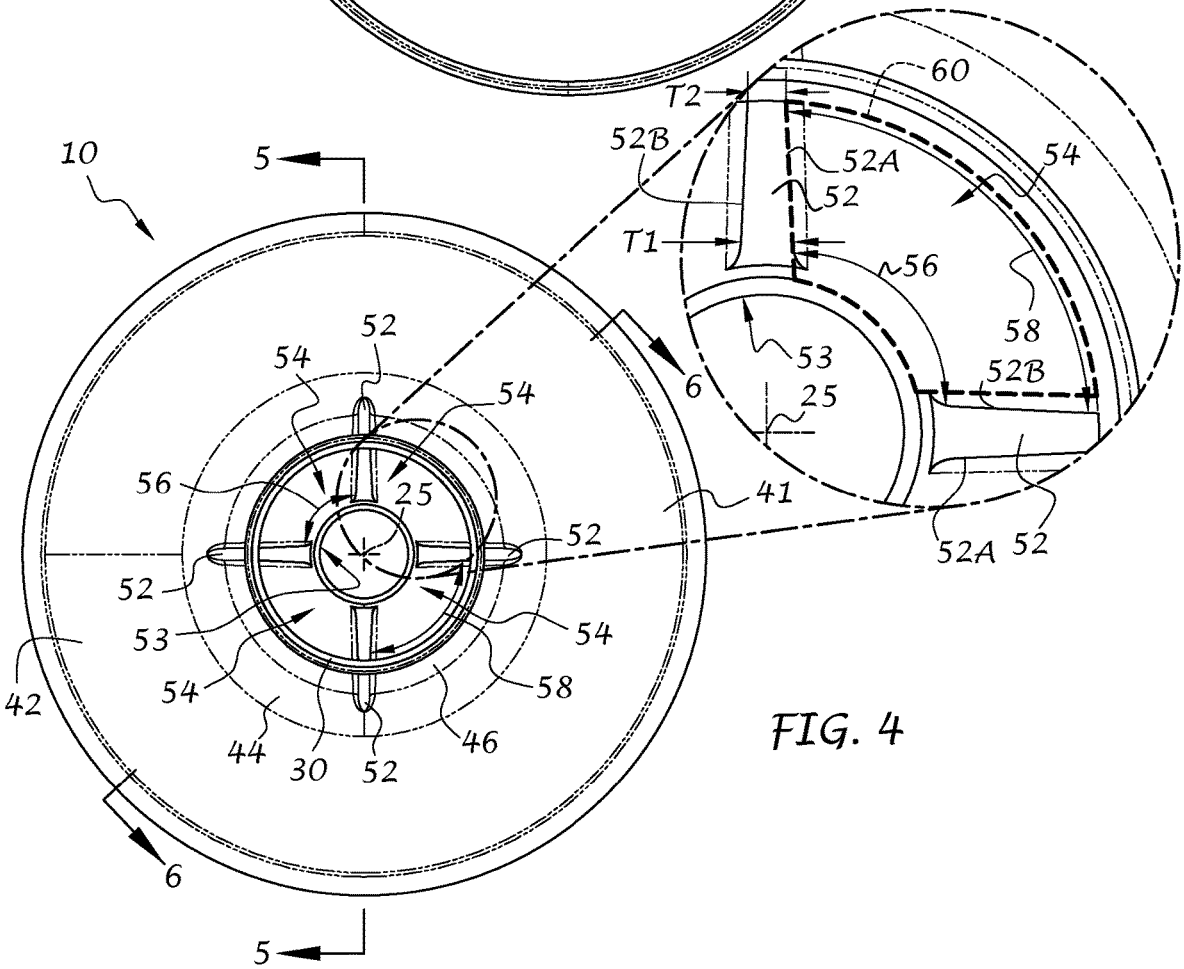
FIG. 4 is a bottom plan view thereof.

As best shown in FIGS. 2, 4, and 5, each rib 52 is generally triangular in shape and has a variable thickness that tapers from the base portion 20 to the converging portion 22, with the thickness T1 (FIG. 4) at the base portion being greater than a thickness T2 at the converging portion. Likewise, in order to maximize the area of each vent opening 54, the thickness T1 of each rib is much less than an inner arc length 56 (FIG. 4) of the vent opening associated with the nozzle portion, and thus an outer arch length 58 of the vent opening associated with the base portion.

With particular reference to FIG. 4, and as more clearly shown in the enlarged view, each vent opening 54, as viewed in the bottom plan view, forms a two-dimensional truncated conical shaped area 60 (shown in thicker dashed line) defined by a first edge 52A of one rib 52, the outer arc or arc length 58, a second edge 52B of an adjacent rib 52, and the inner arc or arc length 56. Preferably, the combined truncated conical shaped areas 60 of the vent openings 54 is approximately equal to the area of the discharge port 53 of the nozzle portion 24, so that air within the container 12 can escape as fast as it is displaced by liquid entering into the container from the vented funnel, thereby avoiding interference with liquid flowing through the funnel. The placement of the vent openings around the discharge port, along with the relatively small height H4 of the nozzle portion 24, ensures that efficient transfer of liquid into the container can occur while substantially reducing frictional resistance of the liquid against the funnel material at the nozzle portion. The particular location and shape of the vent openings together with the height H4 of the nozzle portion 24 also helps to inhibit liquid exiting through the discharge port from being sucked through the vent openings.

Referring now to FIGS. 9-16, a vent funnel 110 in accordance with a further exemplary embodiment of the invention is illustrated. The vented funnel 110 is somewhat similar to the vented funnel 10 previously described, with the exception of a vent portion 126 and changes in the surrounding structure of the converging portion 122 to accommodate the particular exemplary configuration of the vent portion 126.

The converging portion 122 comprises a continuous wall 141 with the first converging section 42, the second converging section 44 extending downwardly and inwardly from the first converging section 42, and a third converging section 146 extending downwardly and inwardly from the second converging section 44 to the nozzle portion 24.

The vent portion 126 is located between the base portion 20 and the converging portion 122 and includes a plurality of supports or ribs 152 that extend between the upper edge 32 of the base portion 20 and the continuous wall 141 associated with the third converging section 146. Vent openings 154 are located between adjacent ribs 152 to allow air to escape from the container 12, as shown by arrows 55 in FIG. 14, when displaced by liquid discharged into the container from the nozzle portion 24. Lower wall segments 155 (see FIGS. 12 and 13) of the continuous wall 141 extend to the base portion 20 around the vent openings 154, so that the converging portion 122 is supported by both the ribs 152 and the lower wall segments 155.

Figure 12:
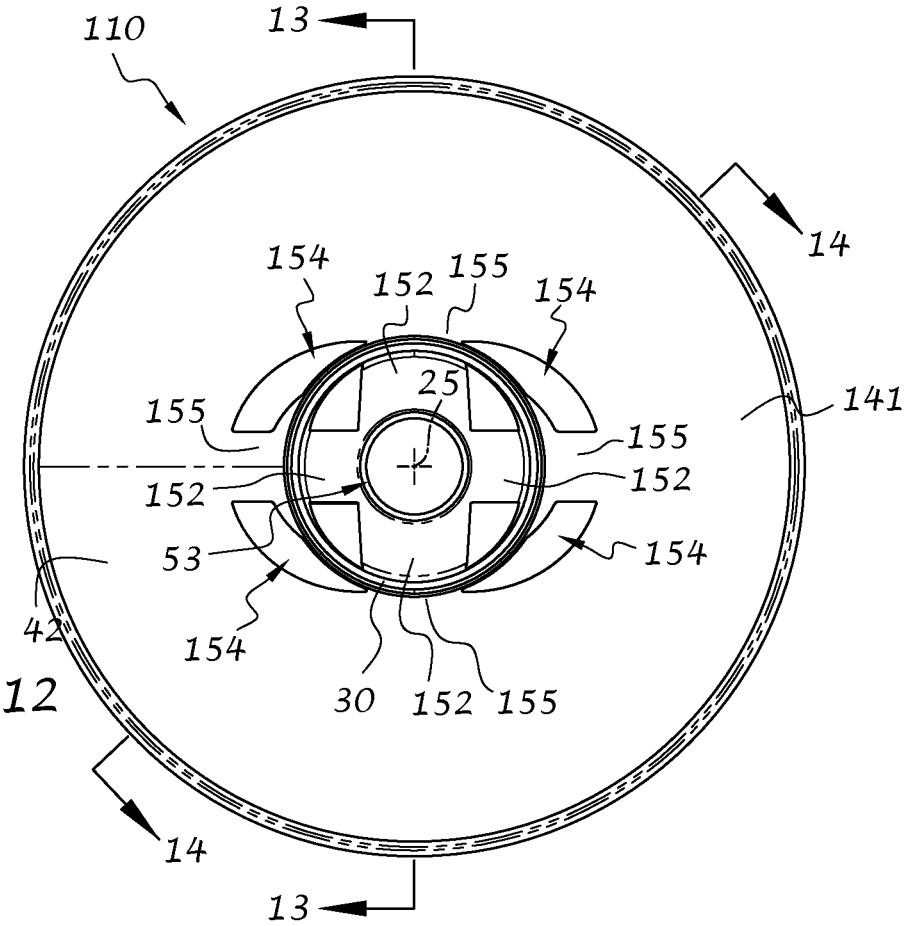
FIG. 12 is a bottom plan view thereof.

In accordance with an exemplary embodiment of the invention, and as best shown in FIG. 12, four ribs 152 extend radially outwardly from the central axis 25 of the nozzle portion 24 and are spaced equidistant about a periphery of the nozzle portion 24 to form four vent openings 154 through which air in the container can escape. Likewise, four wall segments 155 are in alignment with the ribs 152 for adding additional support for the base portion 20. It will be understood that more or less ribs, wall segments, and/or vent openings can be provided without departing from the spirit and scope of the invention.

Figure 13:
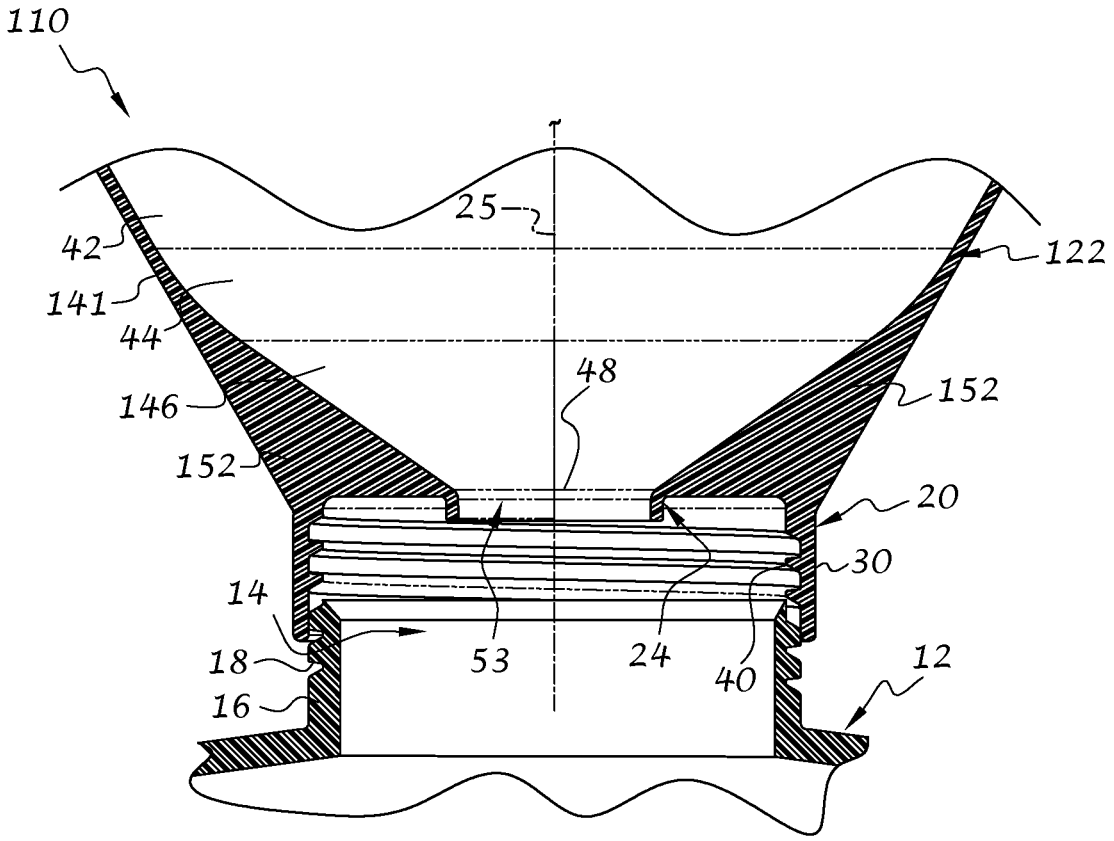
FIG. 13 is an enlarged cross-sectional view thereof taken along line 13-13 of FIG. 12 for connection to a container.
Figure 14:
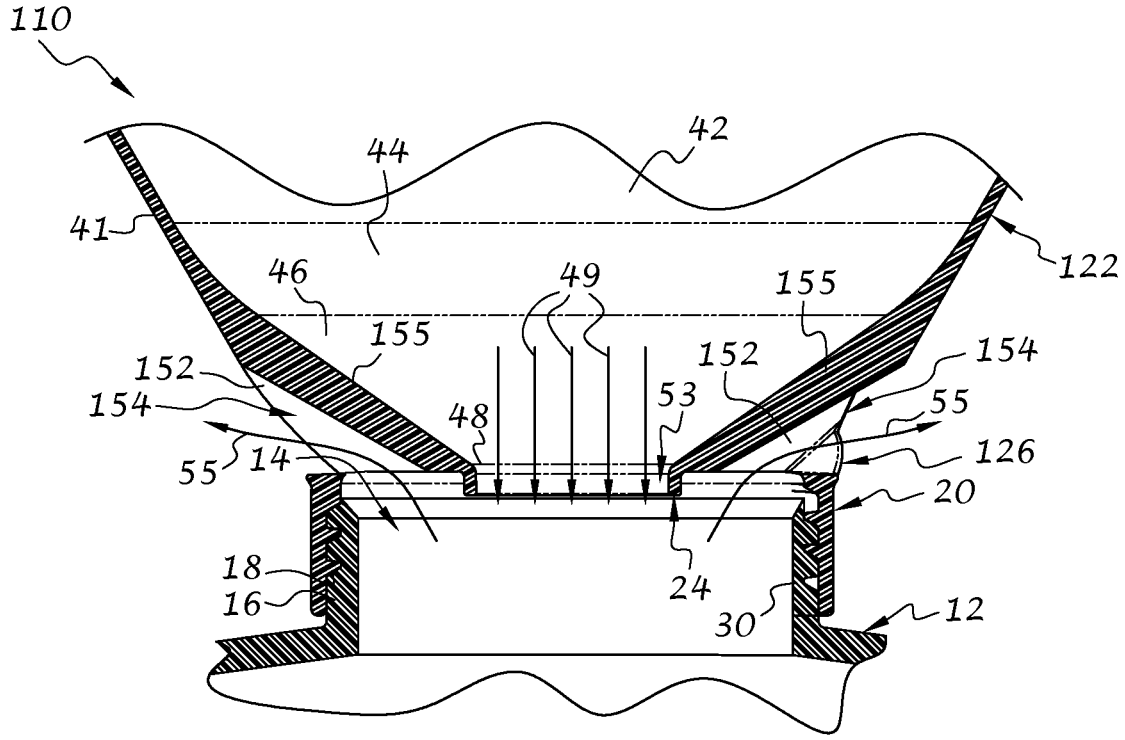
FIG. 14 is an enlarged diagonal cross-sectional view thereof taken along line 14-14 of FIG. 12 connected to a container.

As best shown in FIG. 13, each rib 152 is generally triangular in shape and has an increasing thickness as it extends downwardly from the third converging section 146 toward the base portion 20.

Figure 15:
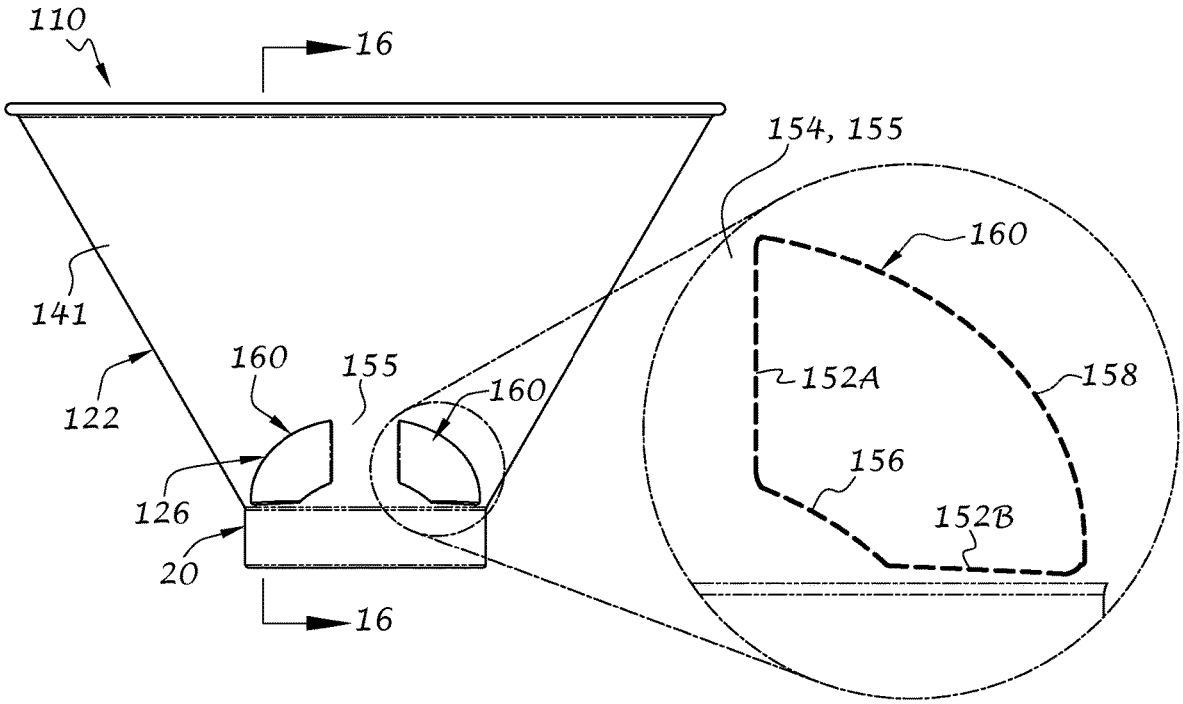
FIG. 15 is a side elevational view thereof.
Figure 16:
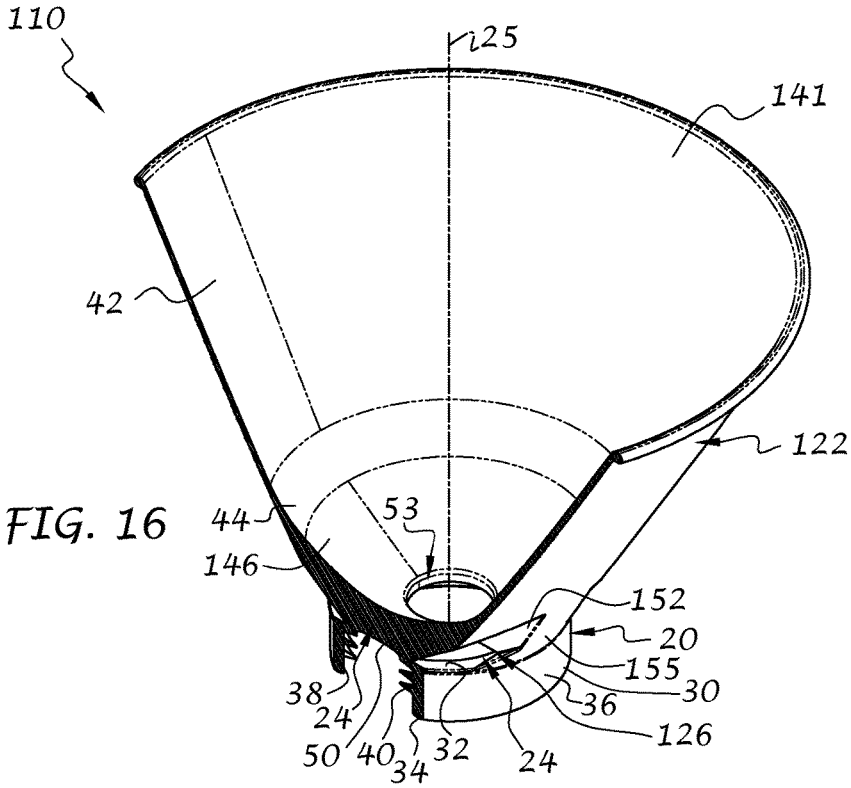
FIG. 16 is an isometric sectional view taken along line 16-16 of FIG. 15.
Figure 17:
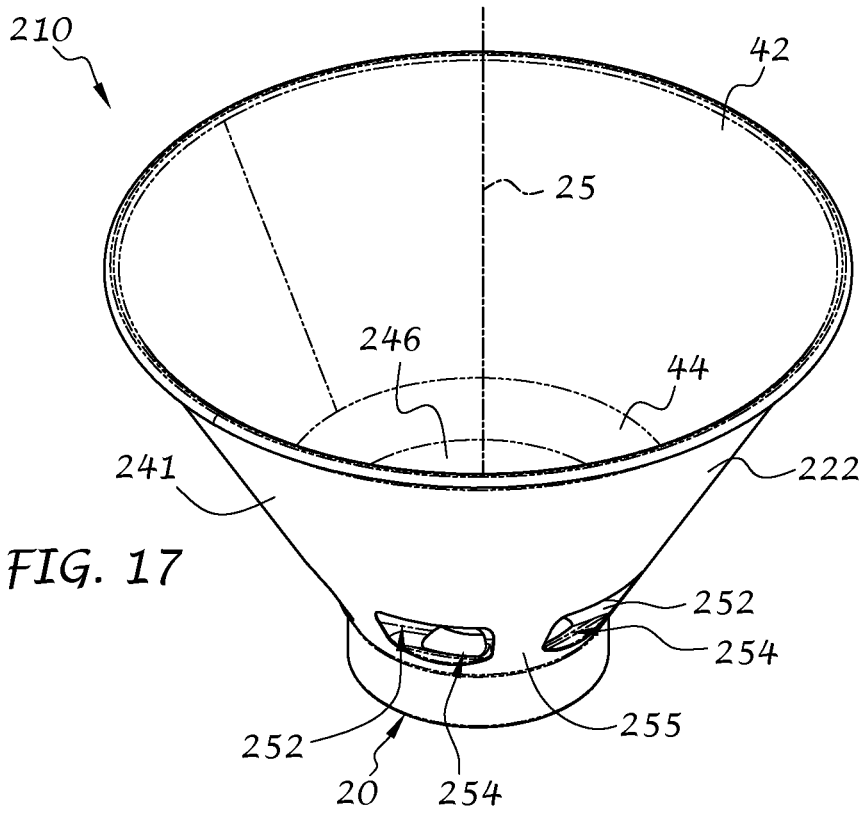
FIG. 17 is a top isometric view of a vented funnel in accordance with yet a further exemplary embodiment of the invention.

With particular reference to FIG. 15, and as more clearly shown in the enlarged view, each vent opening 154, as seen in the side elevational view, forms a two-dimensional truncated conical shaped area 160 (shown in thicker dashed line) defined by a first edge 152A of one rib 152, an outer arc or arc length 158, a second edge 1528 located adjacent to the base portion 20, and an inner arc or arc length 156. Preferably, the combined truncated conical shaped areas 160 of the vent openings 154 is approximately equal to the area of the discharge port 53 of the nozzle portion 24, so that air within the container 12 (FIGS. 13 and 14) can escape as fast as it is displaced by liquid entering into the container from the vented funnel, thereby avoiding interference with liquid flowing through the funnel. The placement of the vent openings around the discharge port, along with the relatively small height H4 of the nozzle portion 24, ensures that efficient transfer of liquid into the container can occur while substantially reducing frictional resistance of the liquid against the funnel material at the nozzle portion. The particular location and shape of the vent openings together with the height H4 of the nozzle portion 24 also helps to inhibit liquid exiting through the discharge port from being sucked through the vent openings.

Referring now to FIGS. 17-24, a vent funnel 210 in accordance with yet a further exemplary embodiment of the invention is illustrated. The vented funnel 210 is somewhat similar to the vented funnel 10 and the vented funnel 110 previously described, with the exception of a vent portion 226 and changes in the surrounding structure of the converging portion 222 to accommodate the particular exemplary configuration of the vent portion 226.

The converging portion 222 comprises a continuous wall 241 with the first converging section 42, the second converging section 44 extending downwardly and inwardly from the first converging section 42, and a third converging section 246 extending downwardly and inwardly from the second converging section 44 to the nozzle portion 24.

The vent portion 226 is located between the base portion 20 and the converging portion 222 and includes a plurality of supports or ribs 252 that extend between the upper edge 32 of the base portion 20 and the continuous wall 241 associated with the third converging section 246. Vent openings 254 are located between adjacent ribs 252 to allow air to escape from the container 12, as shown by arrows 55 in FIG. 22, when displaced by liquid discharged into the container from the nozzle portion 24. Lower wall segments 255 of the continuous wall 241 extend to the base portion 20 around the vent openings 254, so that the converging portion 222 is supported by both the ribs 252 and the lower wall segments 255.

Figure 20:
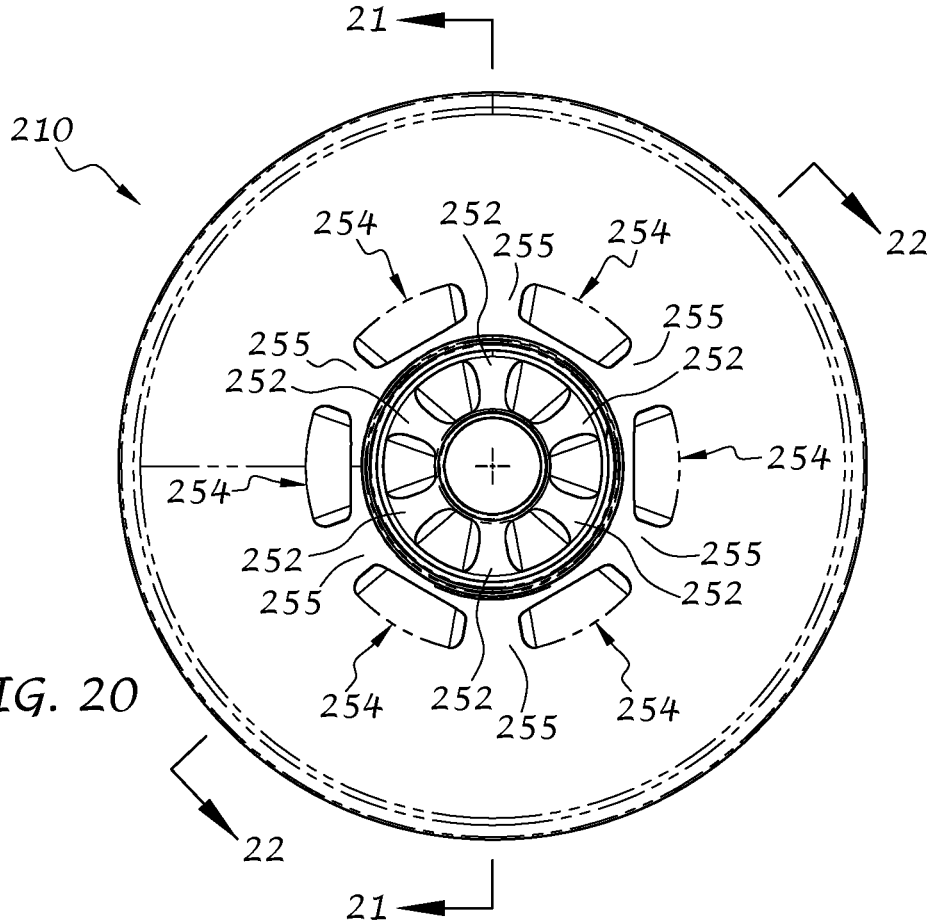
FIG. 20 is a bottom plan view thereof.

In accordance with an exemplary embodiment of the invention, and as best shown in FIG. 20, six ribs 252 extend radially outwardly from the central axis 25 of the nozzle portion 24 and are spaced equidistant about a periphery of the nozzle portion 24 to form six vent openings 254 through which air in the container can escape. Likewise, six wall segments 255 are in alignment with the ribs 252 for adding additional support for the base portion 20. It will be understood that more or less ribs, wall segments, and/or vent openings can be provided without departing from the spirit and scope of the invention.

Figure 21:
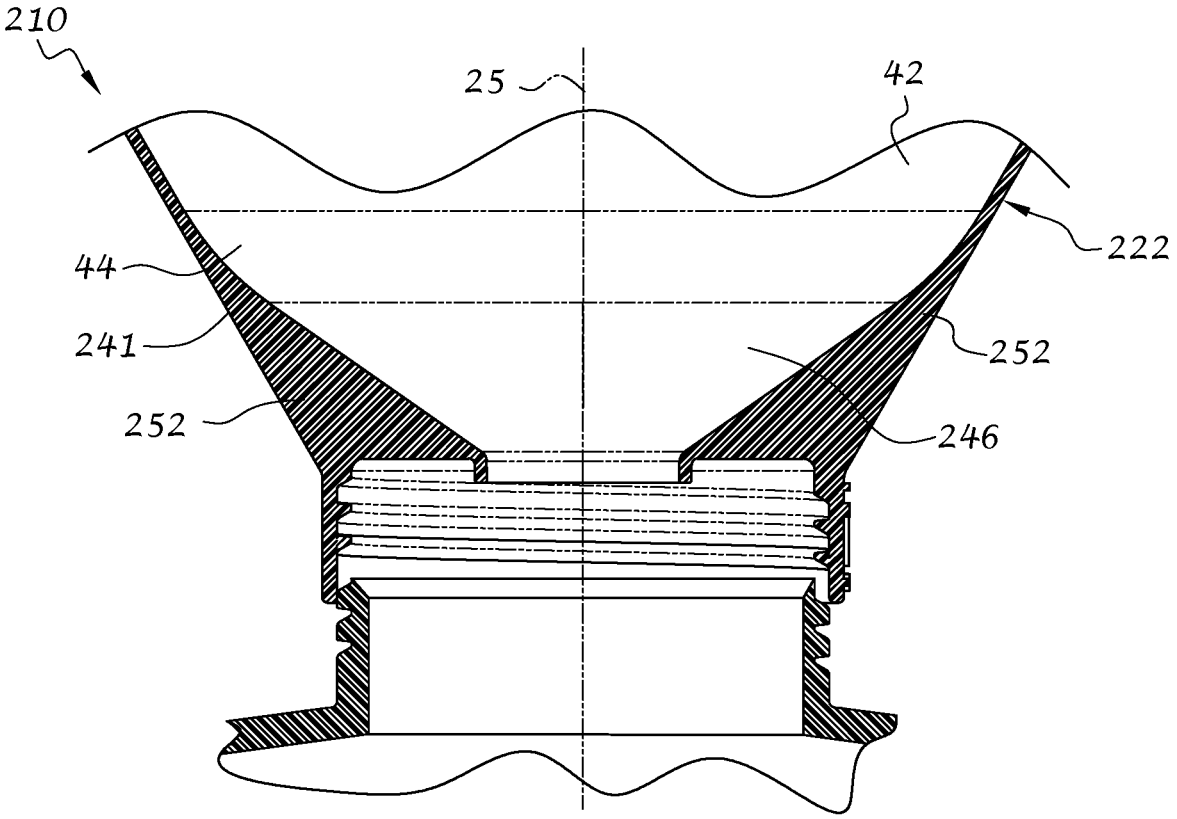
FIG. 21 is an enlarged cross-sectional view thereof taken along line 21-21 of FIG. 20 for connection to a container.
Figure 22:
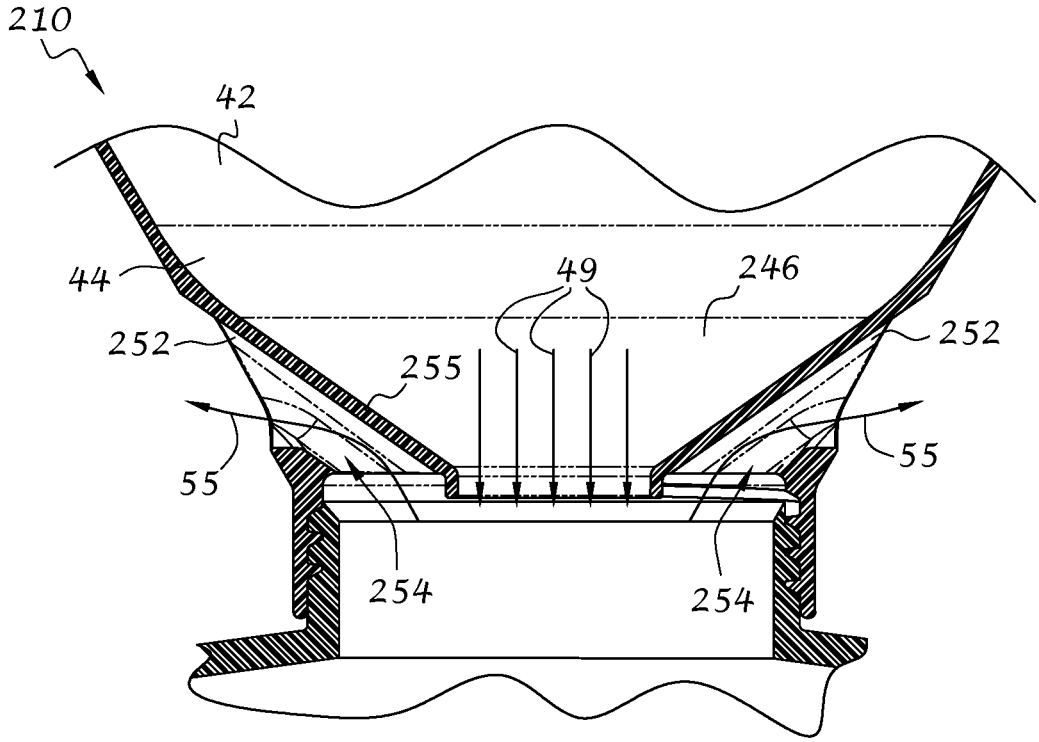
FIG. 22 is an enlarged diagonal cross-sectional view thereof taken along line 22-22 of FIG. 20 connected to a container.

As best shown in FIG. 21, each rib 252 is generally triangular in shape and has an increasing thickness as it extends downwardly from the third converging section 146 toward the base portion 20.

Figure 18:
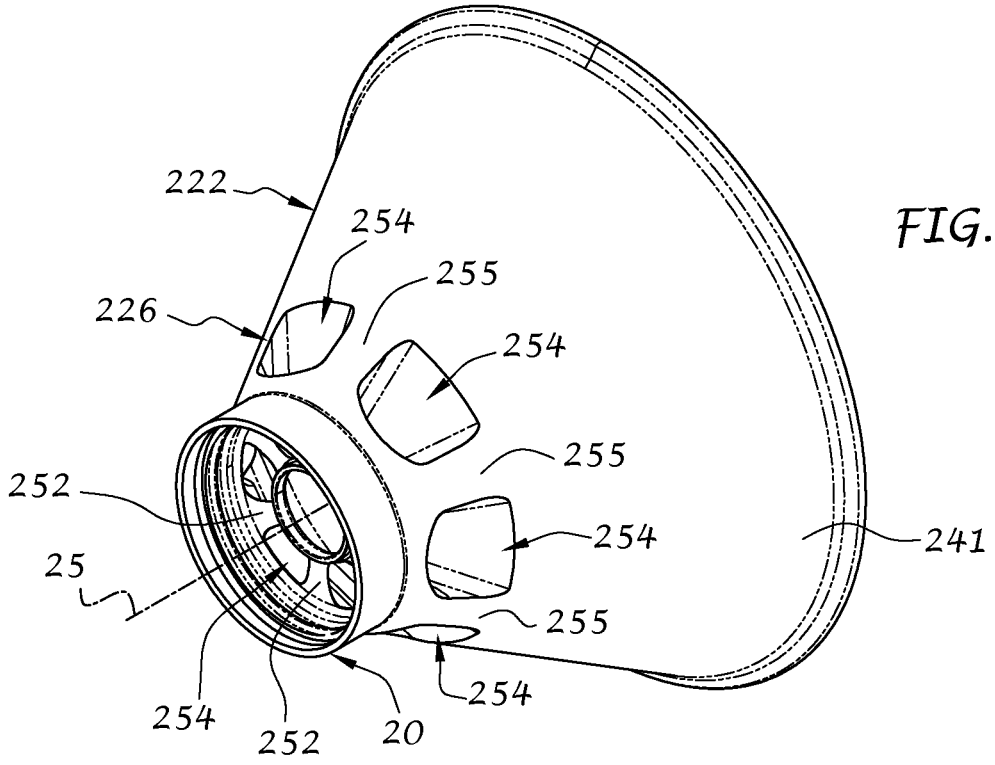
FIG. 18 is a bottom isometric view thereof.
Figure 19:
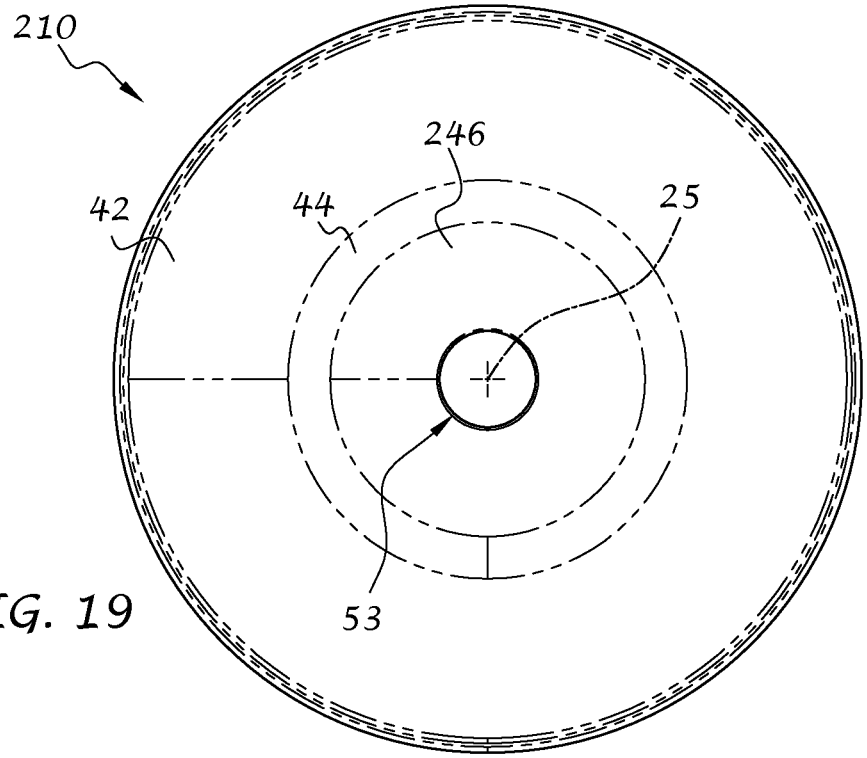
FIG. 19 is a top plan view thereof.
Figure 23:
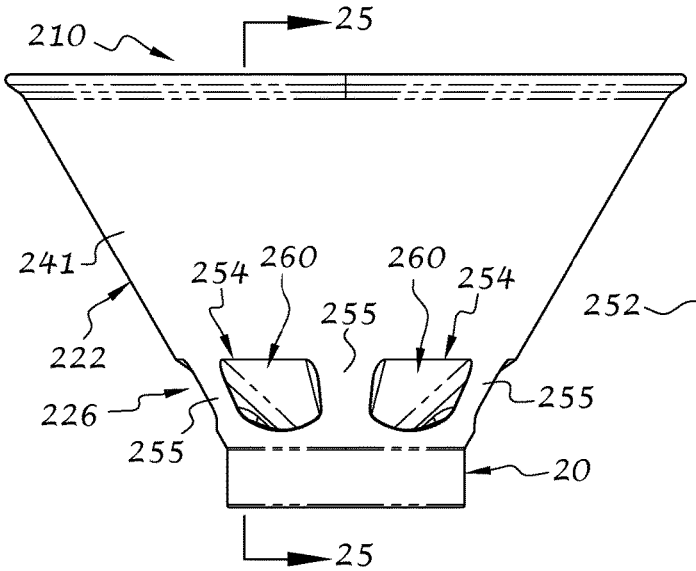
FIG. 23 is a rear elevational view thereof.
Figure 24:
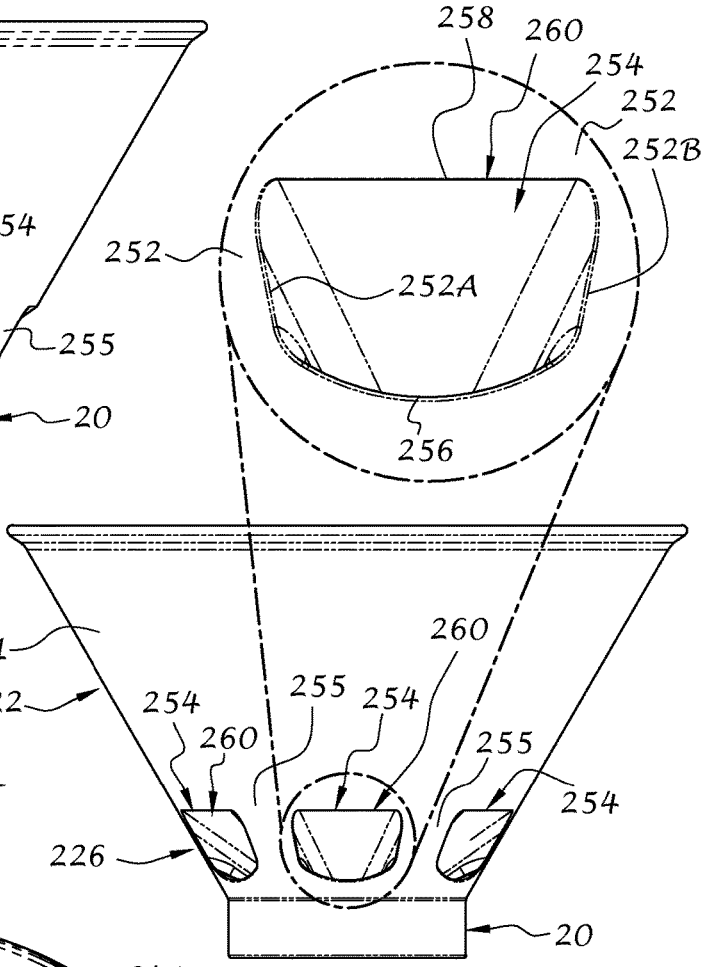
FIG. 24 is a side elevational view thereof.
Figure 25:
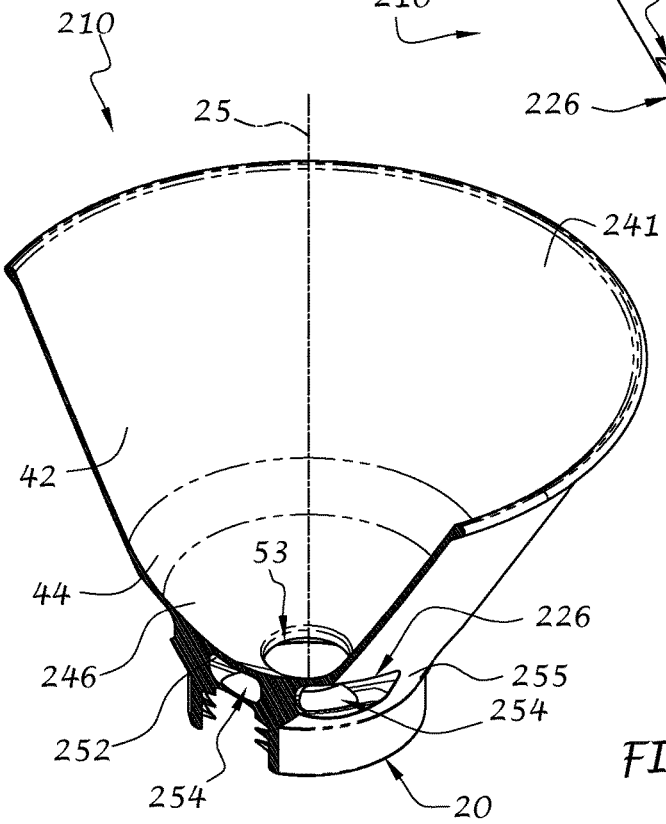
FIG. 25 is an isometric sectional view taken along line 25-25 of FIG. 23.

With particular reference to FIGS. 18, 23, and 25, and as more clearly shown in FIG. 25, each vent opening 254, as seen in the side elevational view, forms a two-dimensional generally trapezoidal shaped area 260 defined by a first edge 252A of one rib 252, a first edge 258 associated with the wall 241, a second edge 252B of an adjacent rib 252, and an inner arc or arc length 256. Preferably, the combined area of the trapezoidal shaped areas 260 of the vent openings 254 is approximately equal to the area of the discharge port 53 of the nozzle portion 24, so that air within the container 12 (FIGS. 21 and 22) can escape as fast as it is displaced by liquid entering into the container from the vented funnel 210, thereby avoiding interference with liquid flowing through the funnel. The placement of the vent openings 254 around the discharge port 53, along with the relatively small height H4 of the nozzle portion 24, ensures that efficient transfer of liquid into the container can occur while substantially reducing frictional resistance of the liquid against the funnel material at the nozzle portion. The particular location and shape of the vent openings together with the height H4 of the nozzle portion 24 also helps to inhibit liquid exiting through the discharge port from being sucked through the vent openings.

Although several shapes and configurations have been shown and described with respect to the vent portions of each embodiment, it will be understood that other shapes and configurations are contemplated without departing from the spirit and scope of the present invention.

It will be understood that the term "preferably" as used throughout the specification refers to one or more exemplary embodiments of the invention and therefore is not to be interpreted in any limiting sense.

It will be further understood that the term "connect" and its derivatives refers to two or more parts capable of being attached together either directly or indirectly through one or more intermediate members. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that this invention is not limited to the particular embodiments disclosed, but is intended to cover modifications within the spirit and scope of the present invention as defined by the appended claims.

What is claimed is:

1. A vented funnel for transferring liquid from one container to another, the vented funnel comprising:
- a base portion adapted for connection to the container;
- a converging portion connected to the base portion and extending upwardly and outwardly therefrom;
- a nozzle portion extending downwardly from the converging portion;
- a vent portion located between the base portion and the converging portion; and
- the base portion, converging portion, and nozzle portion having a central axis extending therethrough;
- the vent portion having:
  - a plurality of vent openings extending between the base portion and the converging portion; and
  - a plurality of ribs located between the vent openings so that each vent opening is separated from an adjacent vent opening by one of the plurality of ribs;
  - the plurality of ribs being aligned with the central axis and extending between the base portion and the converging portion so that only the plurality of ribs support the converging portion on the base portion;
  - wherein air within the container flows through the vent openings when liquid discharged from the converging portion displaces air in the container.

2. A vented funnel according to claim 1, wherein the converging portion comprises:
- a first continuous wall having a first converging section with a first slope A1; and
- at least a further converging section with a further slope A3 different from the first slope.

3. A vented funnel according to claim 2, wherein the further slope A3 is less than the first slope A1.

4. A vented funnel according to claim 3, wherein the nozzle portion comprises a nozzle wall defining a discharge port.

5. A vented funnel according to claim 4, wherein:
- the first converging section has a height H1; and the nozzle wall has a height H4 that is much smaller than the first height to thereby minimize material required for the vented funnel.

6. A vented funnel according to claim 5, wherein the height H4 is sufficient to prevent liquids from being sucked into the vent portion and expelled outside of the container while being discharged through the discharge port.

7. A vented funnel according to claim 3, wherein the converging portion further comprises a second converging section positioned between the first converging section and the further converging section.

8. A vented funnel according to claim 7, wherein the second converging section has a radius of curvature R2 that transitions between the slope A1 and the slope A3.

9. A vented funnel according to claim 8, wherein the second converging section has a height H2 and the further converging section has a height H3.

10. A vented funnel according to claim 9, wherein the height H4 is generally in the range of about 0.15×H3 to about 0.75×H3, and more particularly in the range of about 0.20×H3 to about 0.30×H3.

11. A vented funnel according to claim 10, wherein the height H3 is generally in the range of about 0.15×H1 to about 0.75×H1, and more particularly in the range of about 0.20×H1 to about 0.30×H1.

12. A vented funnel according to claim 11, wherein the height the height H2 of the second converging section 46 is generally in the range of about 0.10×H1 to about 0.30×H1, and more particularly in the range of about 0.12×H1 to about 0.20×H1.

13. A vented funnel for transferring liquid from one container to another, the vented funnel comprising:

a base portion adapted for connection to the container;

a converging portion connected to the base portion; and a vent portion located between the base portion and the converging portion, the vent portion having:

a plurality of vent openings extending between the base portion and the converging portion; and a plurality of ribs located between the vent openings so that each vent opening is separated from an adjacent vent opening by one of the plurality of ribs, such that air within the container flows through the vent openings when liquid discharged from the converging portion displaces air in the container;

wherein each of the plurality of vent openings forms a two-dimensional truncated conical shaped area comprising:

a first edge of one rib of the plurality of ribs;

a second edge of an adjacent rib of the plurality of ribs spaced from the first edge;

a first arc formed by a wall of the converging section extending between the first edge and the second edge; and a second arc formed by a side wall of the base portion extending between the first edge and the second edge and spaced from the first arc.

14. A vented funnel according to claim 13, wherein the two-dimensional truncated cone-shaped area is viewed from a bottom plan view of the vented funnel.

15. A vented funnel according to claim 13, wherein the two-dimensional truncated cone-shaped area is viewed from a side elevational view of the vented funnel.

16. A vented funnel according to claim 1, wherein each of the plurality of vent openings forms a two-dimensional generally trapezoidal shaped area comprising:

a first edge of one rib of the plurality of ribs;

a second edge of an adjacent rib of the plurality of ribs spaced from the first edge;

a third edge associated with a continuous wall of the converging section extending between the first edge and the second edge; and a fourth edge associated with a continuous wall of the base portion extending between the first edge and the second edge, and spaced from the third edge.

17. A vented funnel according to claim 1, wherein the plurality of ribs extend radially outwardly from the nozzle portion and are spaced equidistant about a periphery of the nozzle portion.

18. A vented funnel according to claim 1, wherein an area of the vent portion, including the plurality of vent openings, is at least equal to an area of the nozzle portion to thereby allow the quick transfer of liquid through the nozzle portion and the discharge of air from the container when the discharged liquid displaces air in the container.

19. A vented funnel for transferring viscous liquid from one container to another, the vented funnel comprising:

a base portion adapted for connection to the container;

a converging portion connected to the base portion and extending upwardly and outwardly therefrom;

a nozzle portion extending from the converging portion and extending downwardly therefrom;

a vent portion having a plurality of vent openings extending between the base portion and the converging portion; and support means for supporting the converging portion on the base portion, the support means consisting essentially of a plurality of ribs extending between the converging portion and the base portion so that only the ribs support the converging portion on the base portion;

wherein air within the container flows through the vent openings when viscous discharged from the converging portion and into the container displaces air within the container.

20. A vented funnel according to claim 19, wherein, adjacent ribs together with the converging portion and the base portion define the vent openings.

* * * * *